US006616491B2

(12) United States Patent
Matsuda et al.

(10) Patent No.: US 6,616,491 B2
(45) Date of Patent: Sep. 9, 2003

(54) EXHAUST STRUCTURE OF PERSONAL WATERCRAFT

(75) Inventors: Yoshimoto Matsuda, Kobe (JP); Yoshiyuki Kuroyanagi, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/154,611

(22) Filed: May 22, 2002

(65) Prior Publication Data

US 2002/0182948 A1 Dec. 5, 2002

(30) Foreign Application Priority Data

May 31, 2001 (JP) ..... 2001-164344

(51) Int. Cl.[7] ..... B63H 21/38
(52) U.S. Cl. ..... 440/89 R; 440/89 J
(58) Field of Search ..... 440/89, 38–43, 440/55.5, 55.51, 55.52, 55.53, 55.54, 55.55, 55.56, 55.57, 55.58, 89 R, 89 J

(56) References Cited

U.S. PATENT DOCUMENTS 5,007,870 A * 4/1991 Okubo et al. ..... 440/89
5,389,022 A * 2/1995 Kobayashi ..... 440/89
5,957,072 A * 9/1999 Hattori ..... 114/55.57
6,066,014 A 5/2000 Smith et al.
6,206,741 B1 * 3/2001 Matsuda ..... 440/89

* cited by examiner

*Primary Examiner*—Sherman Basinger
(74) *Attorney, Agent, or Firm*—Kolisch Hartwell, P.C.

(57) ABSTRACT

Disclosed is an exhaust structure of a jet-propulsion personal watercraft adapted to eject water pressurized and accelerated by a water jet pump from an outlet port so as to be propelled as the resulting reaction, which is configured to cause an exhaust gas from an engine for driving the water jet pump to be discharged to outside of the watercraft through an exhaust passage constituted by a water muffler, and the like. The exhaust structure is configured to cause the exhaust gas from the engine to flow into a pump room through a hollow portion partially or entirely formed in a pump cover covering a pump room that contains the water jet pump from a bottom side of the watercraft and to be discharged to outside of the watercraft through the pump room. The exhaust structure is advantageously capable of producing a high muffling effect and preventing water ingress into the exhaust passage even when the watercraft is inverted.

9 Claims, 7 Drawing Sheets

EXHAUST STRUCTURE OF PERSONAL WATERCRAFT

BACKGROUND OF THE INVENTION

1. Field of the Invention

The present invention relates to a jet-propulsion personal watercraft (PWC) which ejects water rearward and planes on a water surface as the resulting reaction. More particularly, the present invention relates to an exhaust structure of the personal watercraft capable of preventing water ingress into an exhaust system when the watercraft is inverted, and of producing a high muffling effect.

2. Description of the Related Art

In recent years, so-called jet-propulsion personal watercraft have been widely used in leisure, sport, rescue activities, and the like. The personal watercraft is configured to have a water jet pump that pressurizes and accelerates water sucked from a water intake generally provided on a hull bottom surface and ejects it rearward from an outlet port. Thereby, the personal watercraft is propelled.

In general, in the personal watercraft, an exhaust gas from an engine for driving the water jet pump is introduced through an exhaust passage including a water muffler and discharged outside the watercraft through an exhaust outlet provided in a transom board.

The water muffler has an internal structure called "labyrinth structure," capable of preventing water entering through the exhaust outlet from reaching the engine, even when the watercraft is inverted. Such a structure is especially advantageous because waves following behind the watercraft sometimes enter the exhaust outlet when the watercraft is inverted. In particular, in the personal watercraft in which a four-cycle engine is equipped, the water ingress into the engine sometimes affects an engine power characteristic, and, therefore, it is essential that the water ingress into the engine be prevented.

While the water muffler has a muffling function because of its labyrinth structure, a relatively loud exhaust sound is sometimes generated depending on the driving condition of the watercraft, since the exhaust gas is discharged rearwardly through the exhaust outlet located above the planing surface in the above constitution.

In light of environmental problems, such an exhaust sound is needed to be reduced.

As a solution to the above-mentioned problem, U.S. Pat. No. 6,066,014 discloses that a high muffling effect is produced by discharging the exhaust gas into water along a pump cover covering a lower surface of a pump room. However, this constitution is undesirable, because the shape of the pump cover significantly affects a planing performance of the watercraft, and the discharge of the exhaust gas along a planing surface of the pump cover might cause cavitations to occur in the planing surface.

SUMMARY OF THE INVENTION

The present invention addresses the above-described condition, and an object of the present invention is to provide an exhaust structure of a jet-propulsion personal watercraft capable of producing a high muffling effect and preventing water ingress into an exhaust system even when the watercraft is inverted.

The above-described object can be achieved by the jet-propulsion personal watercraft constituted as described below.

An exhaust structure of a personal watercraft of the present invention, adapted to eject water pressurized and accelerated by a water jet pump from an outlet port so as to be propelled as the resulting reaction, is adapted to cause an exhaust gas from an engine for driving the water jet pump to be discharged to outside of the watercraft through an exhaust passage. The personal watercraft includes a pump cover covering a pump room, which contains the water jet pump, from the bottom side of the watercraft. The exhaust passage is configured to cause the exhaust gas from the engine to be discharged to outside of the watercraft through a space in a hollow portion partially or entirely formed in the pump cover and a space in the pump room.

In accordance with the above invention, the exhaust gas from the engine is discharged into the pump room through the hollow portion formed by, for example, double-wall structuring of the pump cover, and then is muffled in the pump room. Therefore, a high muffling effect is produced. In addition, since the exhaust gas is discharged from inside of the pump cover to be located at the highest position and above the water surface to outside of the watercraft without being significantly affected by waves following when the watercraft is inverted, the water ingress into the exhaust system can be prevented. In particular, while the watercraft is planing, the pump room can be maintained in a hollow state without water ingress therein, and, therefore, the water ingress into the exhaust system through the hollow portion hardly occurs.

In the above invention, an exhaust outlet of the hollow portion into the pump room is located in a space surrounded by walls of the pump room and the pump cover. This makes it possible that the water ingress into the exhaust system during planing of the watercraft can be effectively prevented. In addition, the hollow portion may be provided to the pump cover or integrally provided with the pump cover, for example by casting.

In the above invention, the exhaust outlet of the hollow portion into the pump room may be opened upwardly or laterally. Therefore, the watercraft can be designed more freely in view of layout of the hull, the water jet pump, the exhaust system, and the like.

In the above invention, the exhaust outlet of the hollow portion into the pump room may be provided at one spot, or otherwise the exhaust gas may be discharged into the pump room through a plurality of branched exhaust passages from the water muffler to the hollow portion.

Furthermore, an exhaust structure of a personal watercraft of the present invention adapted to eject water pressurized and accelerated by a water jet pump from an outlet port so as to be propelled as the resulting reaction, is adapted to discharge an exhaust gas from an engine for driving the water jet pump outside the watercraft through an exhaust passage. The personal watercraft includes a pump room formed by recessing a rear end portion of the hull, for containing the water jet pump, and a pump cover over the pump room and a part of the hull bottom surface extending forward from the pump room from the bottom side of the watercraft. The exhaust passage has a gap, provided between the hull bottom surface and the pump cover, and for communicating the engine with the pump room. The exhaust passage is configured to cause the exhaust gas from the engine to flow into the pump room through the gap and to be discharged outside the watercraft through the pump room.

In the above invention, without the above identified hollow portion, the exhaust gas from the engine is discharged into the pump room through the gap provided between the hull bottom surface and the pump cover, and for communicating the engine with the pump room. The gap allows the exhaust gas from the engine into the pump room therethrough. Therefore, the above mentioned muffling function and water-ingress-proof function can be achieved with a simple constitution.

As a matter of course, in the above invention, the engine may be a two-cycle engine or a four-cycle engine.

The above and further objects and features of the invention will more fully be apparent from the following detailed description with accompanying drawings.

DETAILED DESCRIPTION OF THE PREFERRED EMBODIMENTS

Hereinafter, a jet-propulsion personal watercraft according to embodiments of the present invention will be described with reference to the drawings.

Embodiment 1

Figure 1:
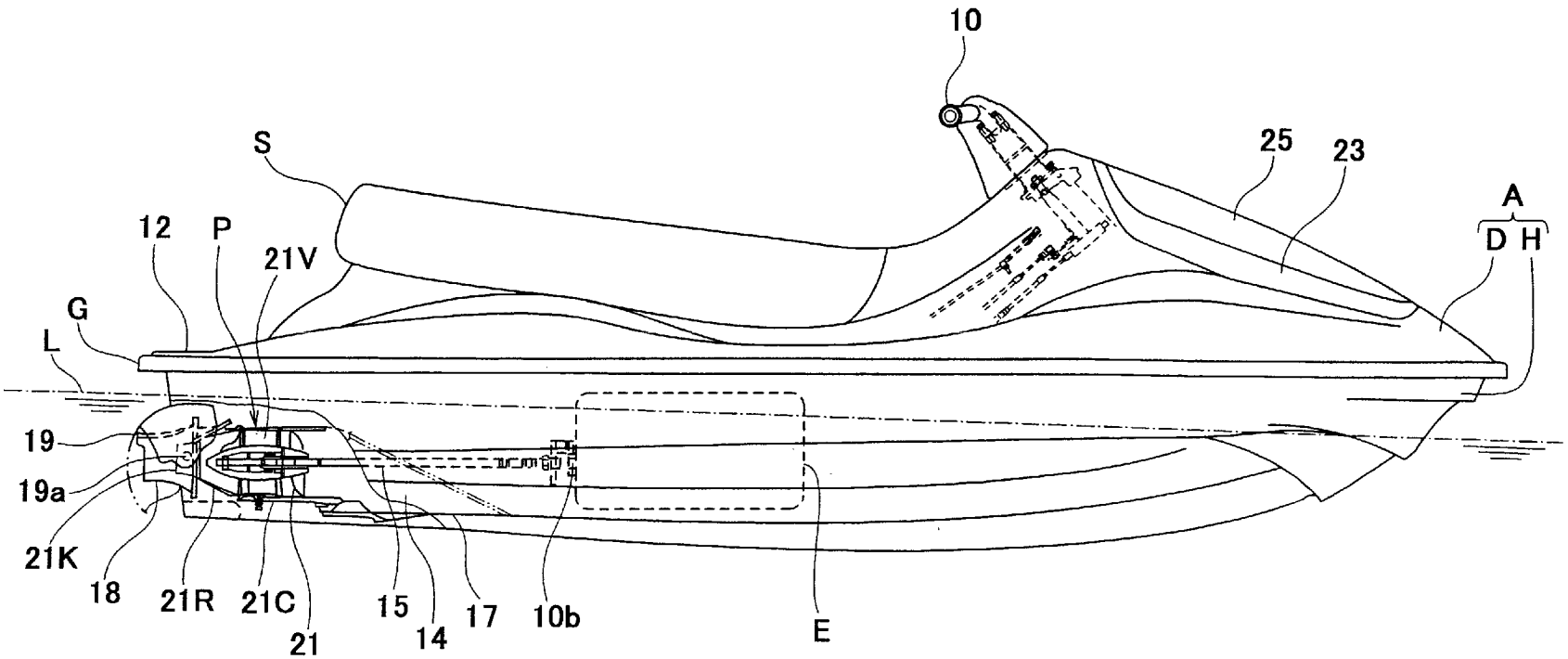
FIG. 1 is a side view showing an entire personal watercraft according to a first embodiment of the present invention.
Figure 2:
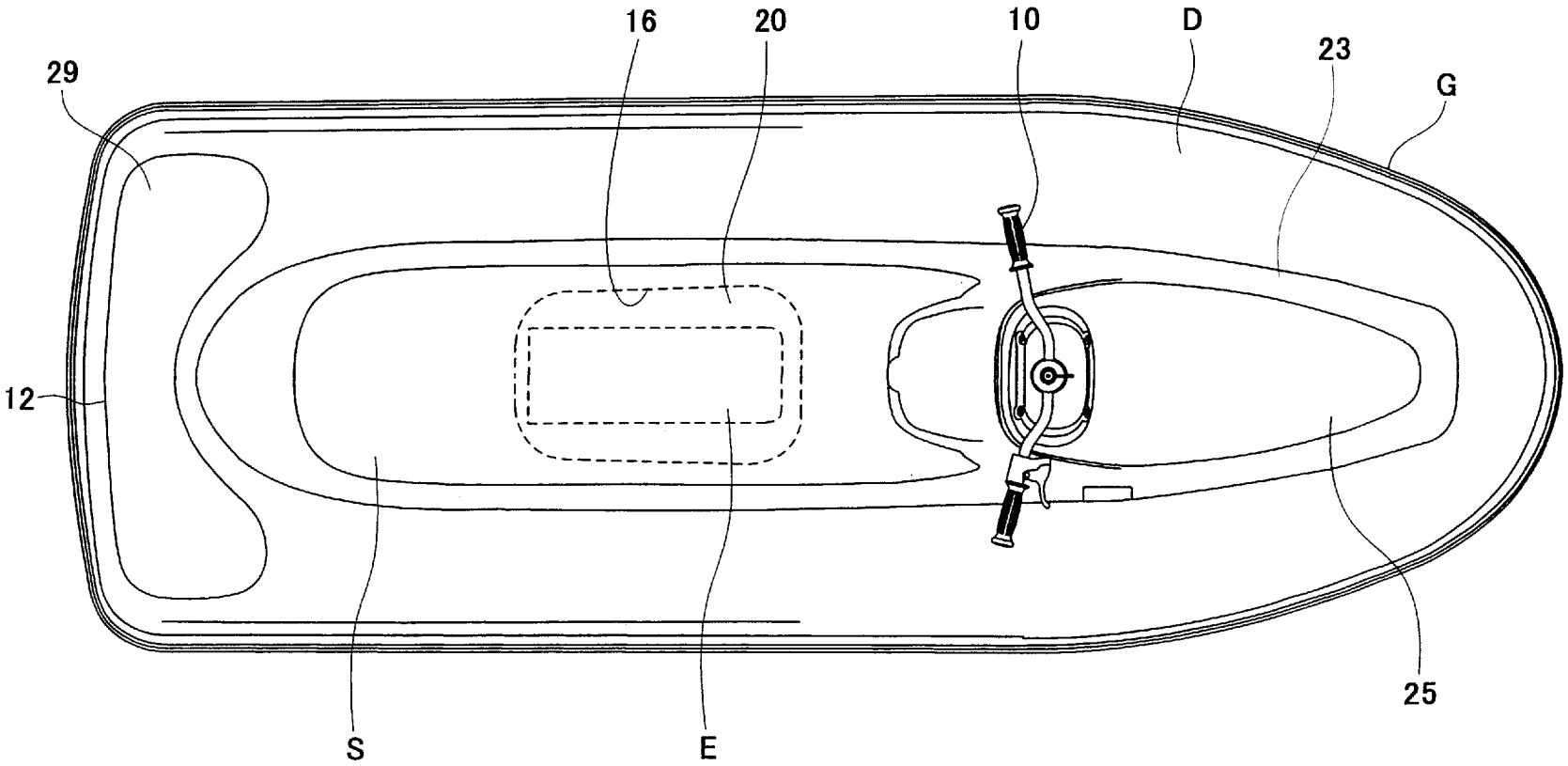
FIG. 2 is a plan view showing the entire personal watercraft of FIG. 1.

FIG. 1 is a side view showing an entire personal watercraft according to a first embodiment of the present invention, and FIG. 2 is a plan view thereof. In FIGS. 1, 2, reference numeral A denotes a body of the personal watercraft. The body A comprises a hull H and a deck D covering the hull H from above. A line at which the hull H and the deck D are connected over the entire perimeter thereof is called a gunnel line G. In this embodiment, the gunnel line G is located above a waterline L of the personal watercraft.

As shown in FIG. 2, an opening 16, which has a substantially rectangular shape seen from above, is formed at a relatively rear section of the deck D such that it extends in the longitudinal direction of the body A, and a riding seat S is provided above the opening 16 such that it covers the opening 16. An engine E is provided in a chamber (engine room) 20 surrounded by the hull H and the deck D below the seat S.

The engine E has multiple cylinders (e.g., three-cylinders). As shown in FIG. 1, a crankshaft 10*b* of the engine E is mounted along the longitudinal direction of the body A. An output end of the crankshaft 10*b* is rotatably coupled integrally with a pump shaft of a water jet pump P through a propeller shaft 15. An impeller 21 is attached on the pump shaft of the water jet pump P. The impeller 21 is covered with a pump casing 21C on the outer periphery thereof.

A water intake 17 is provided on the bottom of the hull H. The water is sucked from the water intake 17 and fed to the water jet pump P through a water intake passage 14. The water jet pump P pressurizes and accelerates the water by rotation of the impeller 21. The pressurized and accelerated water is discharged through a pump nozzle 21R having a cross-sectional area of flow gradually reduced rearward, and from an outlet port 21K provided on the rear end of the pump nozzle 21R, thereby obtaining a propulsion force. In FIG. 1, reference numeral 21V denotes fairing vanes for fairing water flow behind the impeller 21.

As shown in FIGS. 1, 2, reference numeral 10 denotes a bar-type steering handle. The handle 10 operates in association with a steering nozzle 18 swingable around a swing shaft (not shown) to the right or to the left behind the pump nozzle 21R. When the rider rotates the handle 10 clockwise or counterclockwise, the steering nozzle 18 is swung toward the opposite direction so that the watercraft can be correspondingly turned to any desired direction while the water jet pump P is generating the propulsion force.

As shown in FIG. 1, a bowl-shaped reverse deflector 19 is provided above the rear side of the steering nozzle 18 such that it can swing downward around a horizontally mounted swinging shaft 19*a*. The deflector 19 is swung downward to a lower position behind the steering nozzle 18 to deflect the ejected water from the steering nozzle 18 forward, and as the resulting reaction, the personal watercraft moves rearward.

In FIGS. 1, 2, reference numeral 12 denotes a rear deck. The rear deck 12 is provided with an openable rear hatch cover 29. A rear compartment (not shown) with a small capacity is provided under the rear hatch cover 29. In FIGS. 1, 2, reference numeral 23 denotes a front hatch cover. A front compartment (not shown) is provided under the front hatch cover 23 for storing equipments and the like. Another hatch cover 25 is provided over the front hatch cover 23, thereby forming a two-layer hatch cover. Life jackets or the like can be stored under the upper hatch cover 25 through an opening (not shown) provided in the rear end thereof.

Figure 3:
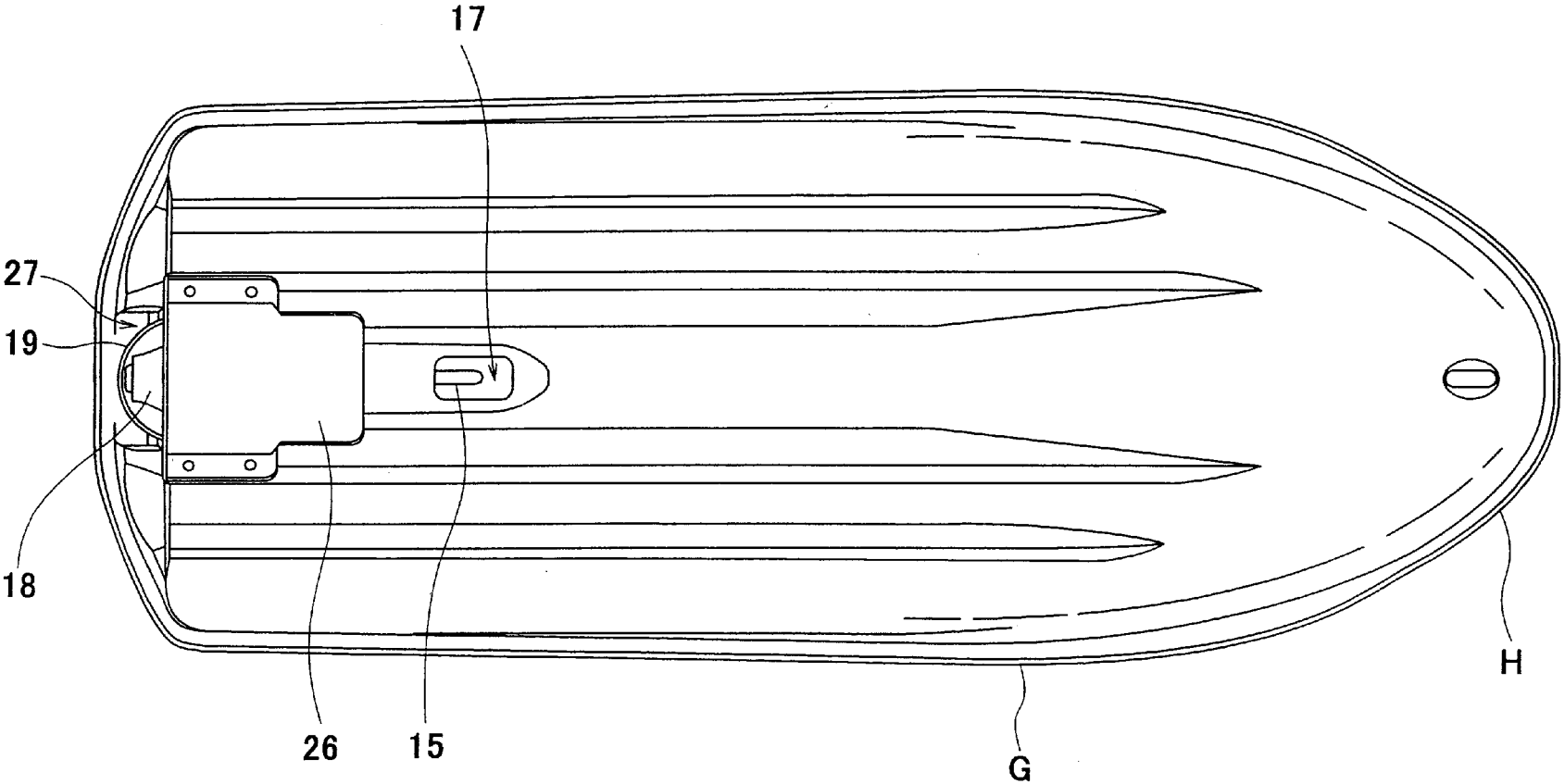
FIG. 3 is a bottom view showing the entire personal watercraft of FIG. 1.
Figure 4:
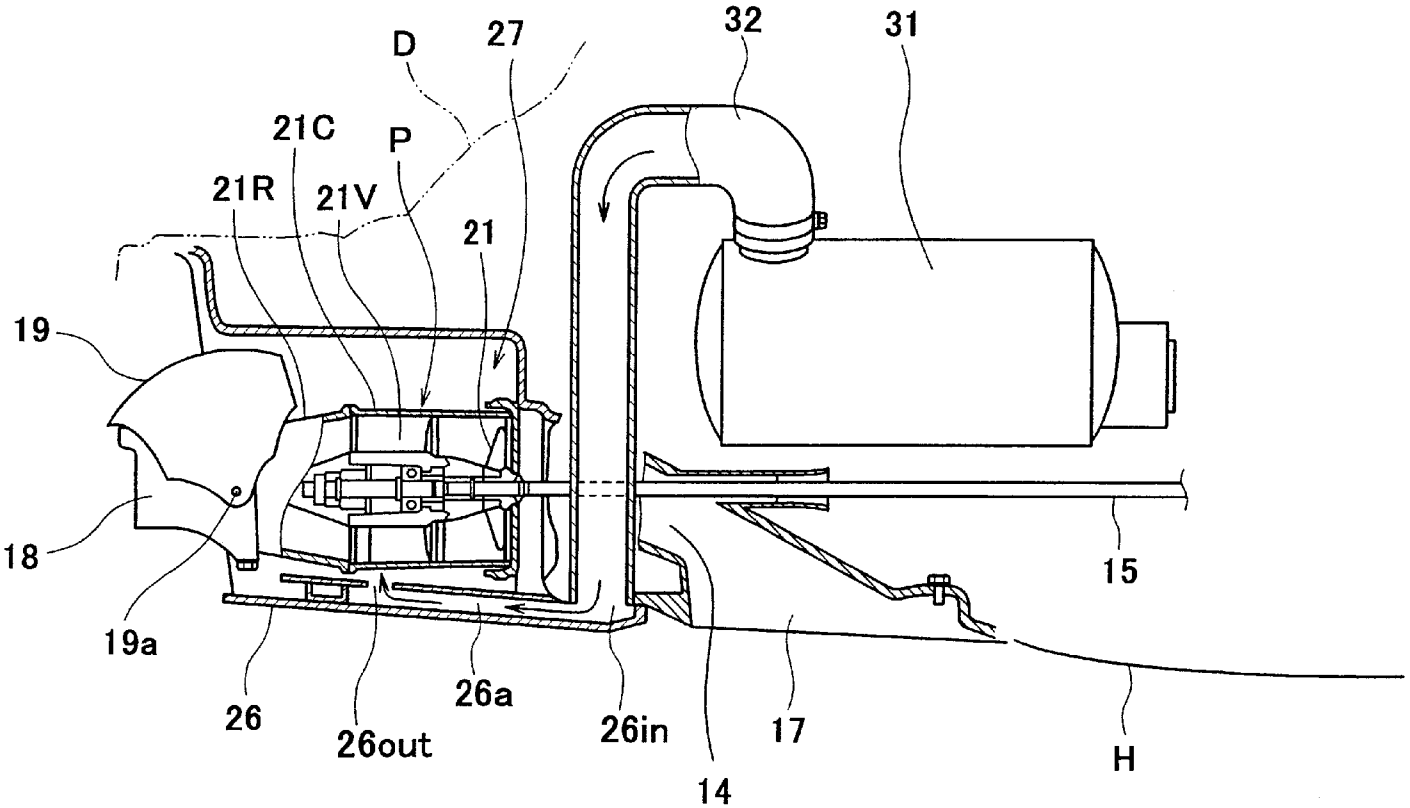
FIG. 4 is a partially cross-sectional view of the personal watercraft of FIG. 1, showing a pump room that contains a water jet pump and its vicinity.

FIG. 3 is a bottom view showing the entire personal watercraft according to the embodiment of the present invention. FIG. 4 is a partially cross-sectional view of the personal watercraft of FIG. 1, showing a pump room that contains the water jet pump and its vicinity. As shown in FIGS. 3, 4, the water jet pump P is contained and fixed in a pump room 27 formed by recessing a rear-end central portion of the hull H in the form of a box. A plate-shaped pump cover 26 manufactured by e.g., aluminum die casting is secured to cover a lower side opening of the pump room 27 by screws via a seal member (not shown).

The aforementioned water intake 17 is provided in front of the pump cover 26. The propeller shaft 15 penetrates through the intake passage 14 for guiding the water sucked through the water intake 17 into the water jet pump P. As clearly shown in FIG. 4, the pump room 27 has an adequate space around the pump casing 21C and this space is almost entirely occupied by only air while the watercraft is planing.

The pump cover 26 partially has a double-wall structure, and therefore has a hollow portion 26*a* between the walls. The hollow portion 26*a* has two openings, i.e., an exhaust inlet 26*in* and an exhaust outlet 26*out*. The exhaust inlet 26*in* is provided outside of the pump room 27. One end of the water muffler 31 is connected to an exhaust side of the engine E and the other end thereof is connected to the exhaust inlet 26*in* through a U-shaped pipe 32. More specifically, a lower end of the U-shaped pipe 32 is extended downwardly to the vicinity of a bottom surface of the hull H. The exhaust inlet 26*in* is opened upwardly to receive the lower end of the U-shaped pipe 32. The exhaust outlet 26*out* is positioned so as to face the pump room 27.

As should be appreciated from the foregoing, the exhaust passage of the personal watercraft is comprised of the water muffler 31, the U-shaped pipe 32, the hollow portion 26*a*, the pump room 27, and the like in this order, from the side of the engine E. The exhaust gas from the engine E is muffled by the water muffler 31 and introduced from the exhaust inlet 26*in* into the hollow portion 26*a* through the U-shaped pipe 32. Then, the exhaust gas is discharged from the exhaust outlet 26*out* into the pump room 27 through the hollow portion 26*a* and further muffled in the pump room 27.

The hollow portion 26*a* provided in the pump cover 26 for discharging the exhaust gas into the pump room 27 may be integrally formed by casting with the pump cover 26. Therefore, the above-mentioned function can be attained merely by slightly altering the existing pump cover 26 without the necessity of an additional member for discharging the exhaust gas from the water muffler 31 into the pump room 27.

Figure 5A:
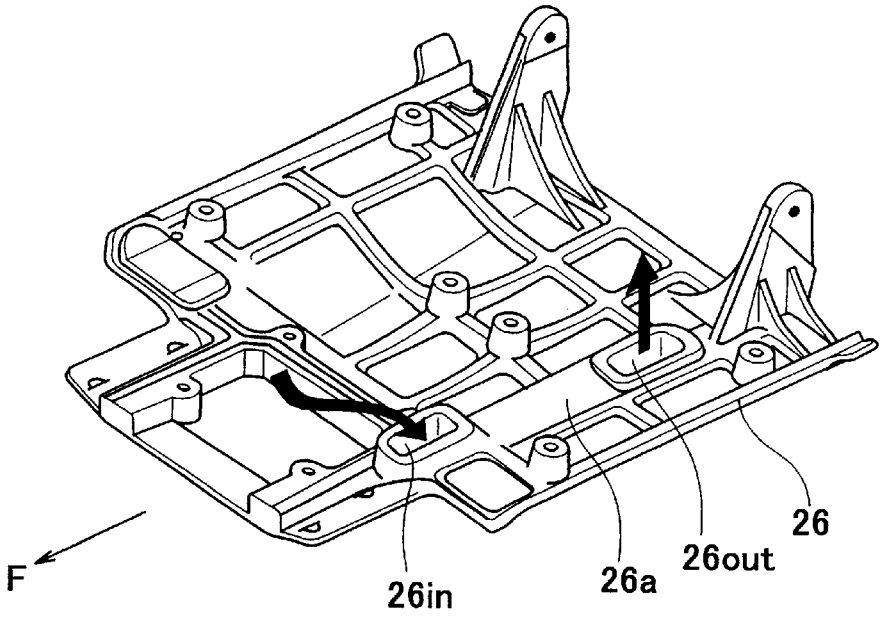
FIG. 5A is a perspective view showing a structure of a hollow portion, and an exhaust inlet thereof and an exhaust outlet thereof, as seen from a front-left side of the pump cover of FIG. 3.
Figure 5B:
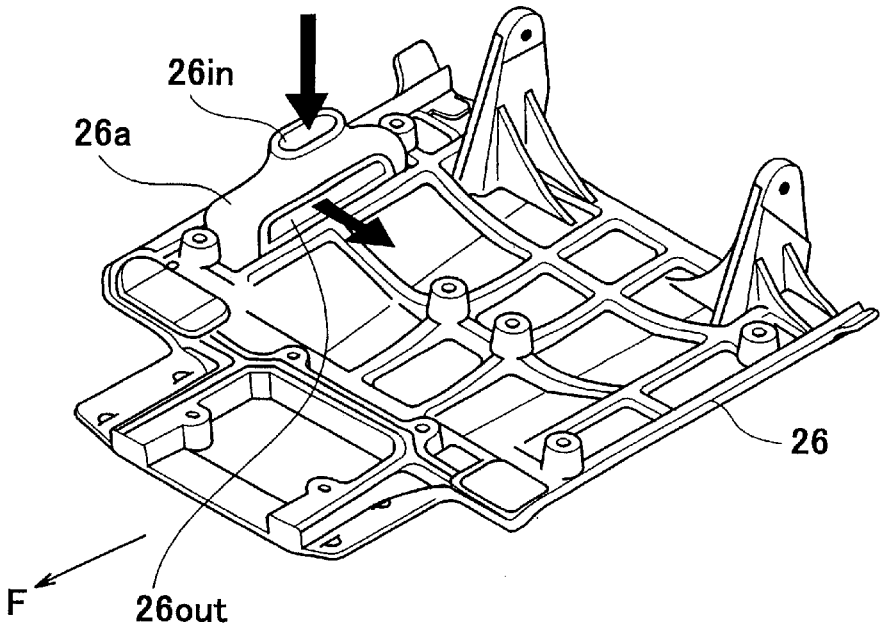
FIG. 5B is a perspective view showing another structure of the hollow portion, and the exhaust inlet thereof and the exhaust outlet thereof, as seen from the front-left side of the pump cover of FIG. 3.

FIGS. 5A, 5B are perspective views showing detailed structures of the hollow portion, the exhaust inlet thereof, and the exhaust outlet thereof, as seen from the front-left side of the pump cover. In FIGS. 5A, 5B, "F" represents a front side of the pump cover 26. As shown in FIG. 5A, the pump cover 26 is provided with a plurality of reinforcement ribs on an upper surface thereof. The hollow portion 26*a* extending in the front-and-rear direction in a left portion of the pump cover 26 can be formed by upwardly protruding the upper wall of the pump cover 26. In the hollow portion 26*a* having such a structure, the exhaust inlet 26*in* may be opened upwardly at a front end of the hollow portion 26*a* and the exhaust outlet 26*out* is opened upwardly at a rear end portion of the hollow portion 26*a*.

The positions of the exhaust inlet 26*in* and the exhaust outlet 26*out* are not intended to be limited to the above. Nonetheless, it is required that the exhaust inlet 26*in* be provided outside of the pump room 27 and covered by the pump cover 26, and the exhaust outlet 26*out* be provided inside of the pump room 27. The position and shape of the hollow portion 26*a* may be determined according to the positions of the exhaust inlet 26*in* and the exhaust outlet 26*out*.

As an alternative, as shown in FIG. 5B, the hollow portion 26*a* may be extended in the front-and-rear direction in a right portion of the pump cover 26 and provided with the exhaust inlet 26*in* opened upwardly in an upper portion thereof and the exhaust outlet 26*out* opened laterally, e.g., to the left side, in a side portion thereof. In this manner, the exhaust inlet 26*in* and the exhaust outlet 26*out* may be opened in various directions.

Embodiment 2

Figure 6:
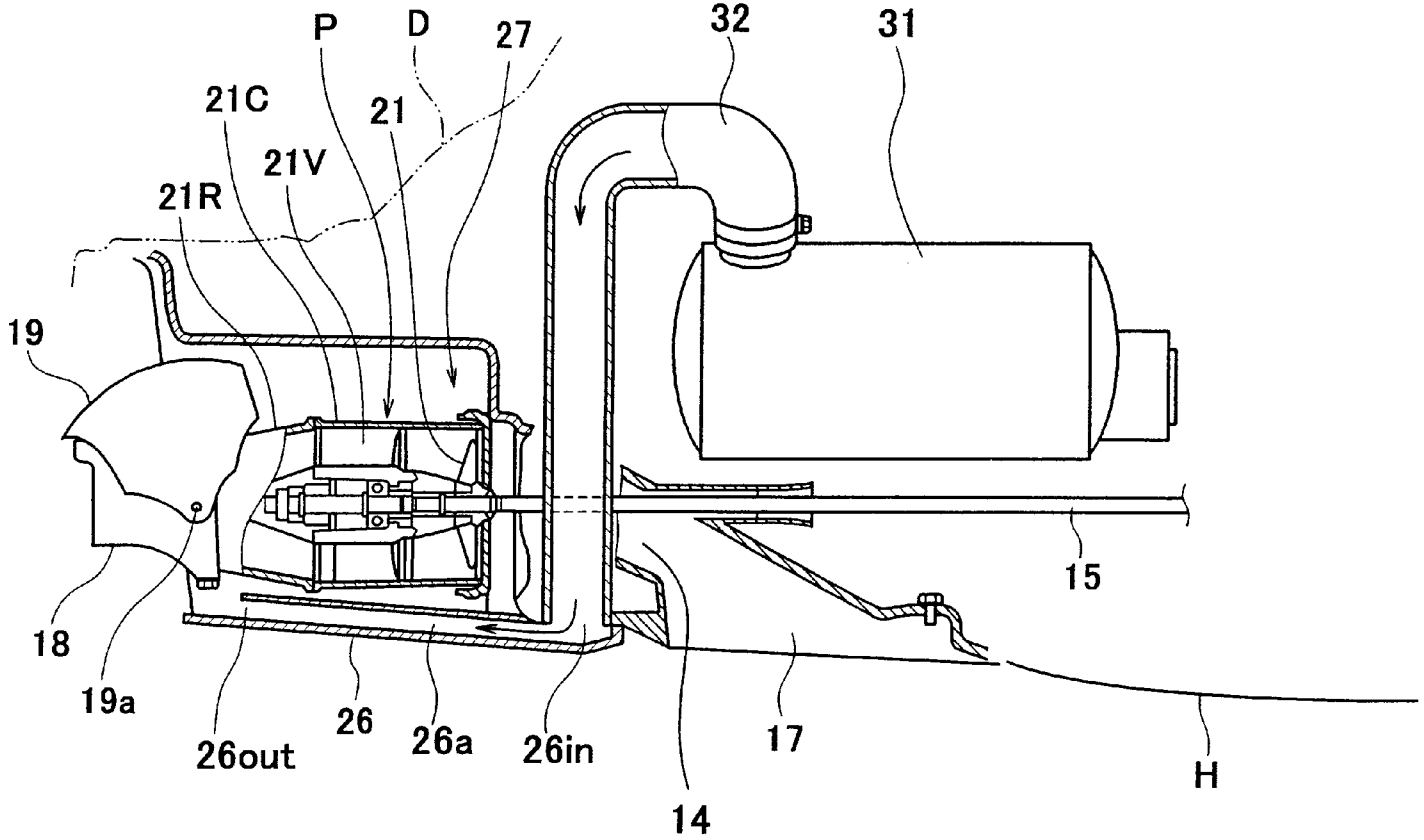
FIG. 6 is a partially cross-sectional view of the personal watercraft, showing a further structure of the hollow portion, and the exhaust inlet thereof and the exhaust outlet thereof.

FIG. 6 is a partially cross-sectional view of the pump room that contains the water jet pump and its vicinity, showing another embodiment of the hollow portion, and the exhaust inlet thereof and the exhaust outlet thereof. As shown in FIG. 6, the hollow portion 26*a* of this embodiment is extended over the entire pump cover 26 in the front-and-rear direction. The exhaust inlet 26*in* is substantially the same as that of the first embodiment. On the other hand, the exhaust outlet 26*out* is opened rearwardly, and the lower wall of the pump cover 26 is extended rearwardly so as to be somewhat longer than the upper wall. As a result, the exhaust gas from the exhaust outlet 26*out* is discharged into the pump room 27 and immediately released to atmosphere.

Since other constitutions and functions of this embodiment are similar to those of the first embodiment, the same reference numerals are used to identify the same or corresponding parts, which will not be further described.

Embodiment 3

Figure 7:
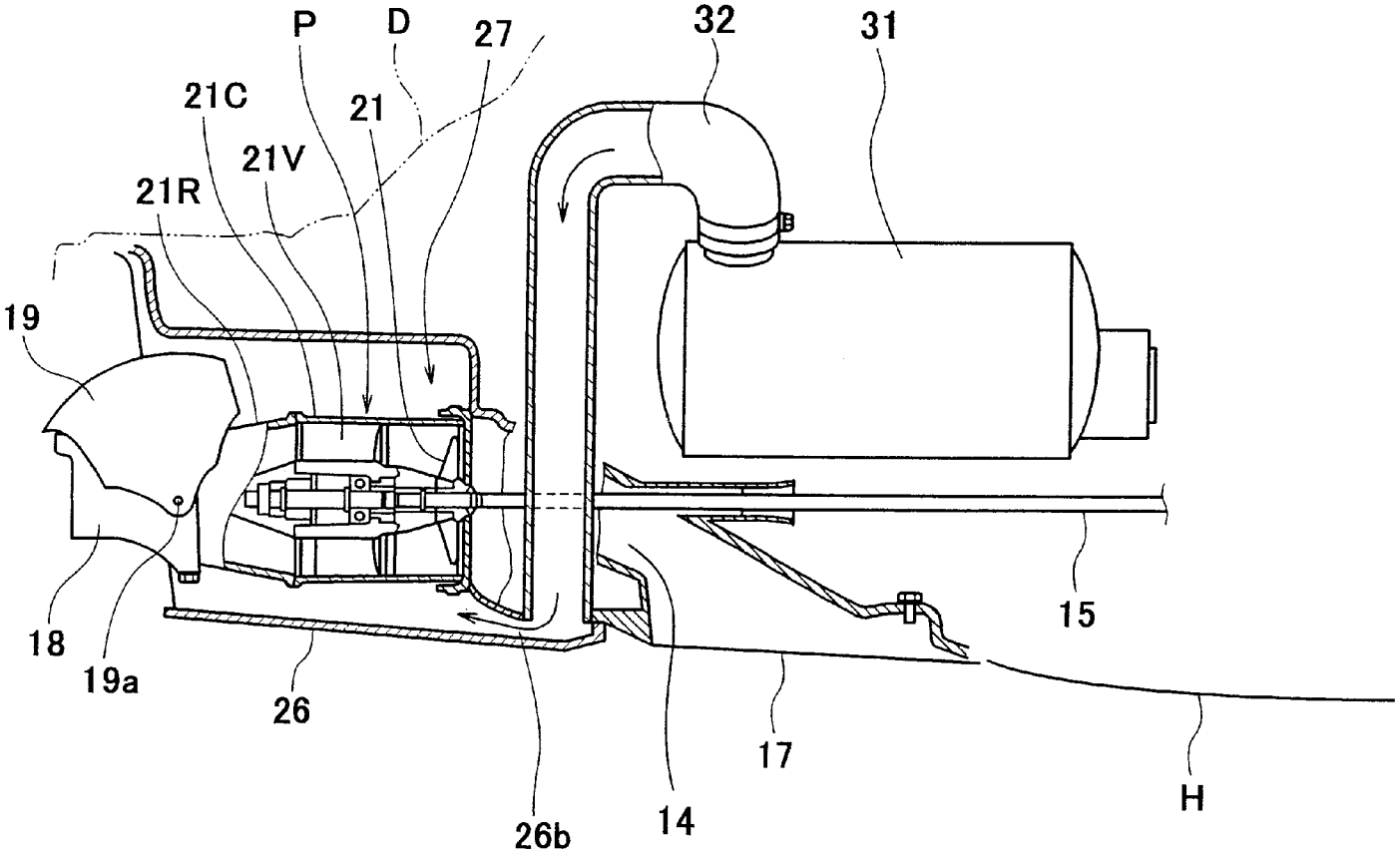
FIG. 7 is a partially cross-sectional view of the personal watercraft, showing a still further structure of an exhaust passage to the pump room.

FIG. 7 is a partially cross-sectional view of the pump room that contains the water jet pump and its vicinity, showing a further embodiment of the exhaust passage to the pump room. As shown in FIG. 7, in this embodiment, instead of providing the hollow portion 26*a* in the pump cover 26, there is provided a gap 26*b* between the hull bottom surface and the pump cover 26, for discharging the exhaust gas from the engine E through the U-shaped pipe 32 into the pump room 27 therethrough.

Since the other constitution and functions of this embodiment are similar to those of the first embodiment, the same reference numerals are used to identify the same or the corresponding parts, which will not be further described.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds thereof, are therefore intended to be embraced by the claims.

What is claimed is:

1. A personal watercraft comprising:

a hull;

a water jet pump including an outlet, the water jet pump pressurizing and accelerating water taken in from outside of the watercraft and ejecting the water from the outlet port to propel the watercraft as a reaction of the ejecting water;

a pump room formed by recessing a rear end portion of the hull, for containing the water jet pump;

a pump cover covering the pump room and a part of the hull bottom surface extending forward from the pump room from a bottom side of the watercraft;

an engine for driving the water jet pump; and an exhaust passage connected to an exhaust port of the engine, for discharging an exhaust gas from the engine to outside of the watercraft, wherein the exhaust passage has a gap, provided between the hull bottom surface and the pump cover, and for communicating the engine with the pump room, and the exhaust passage is configured to cause the exhaust gas from the engine to flow into the pump room through the gap and to be discharged to the outside of the watercraft through the pump room.

2. A personal watercraft comprising:

a water jet pump including an outlet port, the water jet pump pressurizing and accelerating water taken in from outside of the watercraft and ejecting the water from the outlet port to propel the watercraft as a reaction of the ejecting water;

a pump room that contains the water jet pump;

a pump cover covering the pump room from a bottom side of the watercraft, the pump cover being partially or entirely provided with a hollow portion, the hollow portion having an exhaust outlet that opens into the pump room at a location surrounded by walls of the pump room and the pump cover;

an engine for driving the water jet pump; and an exhaust passage connected to an exhaust port of the engine, for discharging an exhaust gas from the engine to outside of the watercraft;

wherein the exhaust passage is configured to cause the exhaust gas to travel successively from the engine, into the hollow portion of the pump cover, through the exhaust outlet of the hollow portion into the pump room, and through the pump room to outside of the watercraft.

3. The personal watercraft of claim 2 wherein the exhaust passage passes through a hull of the watercraft to a location that is external to and adjacent the pump room;

wherein the pump cover extends from below the pump room to also cover from below the location where the exhaust passage passes through the bottom of the hull;

wherein the hollow portion of the pump cover includes an inlet connected a portion of the exhaust passage that passes through the hull, the inlet being configured to receive exhaust gas; and wherein the exhaust outlet of the hollow portion is in communication with the pump room and configured to discharge exhaust gas to the pump room.

4. The personal watercraft according to claim 3, wherein the location where the exhaust passage passes through the hull is forward of the pump room, and on a bottom of the hull;

wherein the portion of the exhaust passage that passes through the bottom of the hull is connected to the inlet of the hollow portion; and wherein the exhaust outlet of the hollow portion opens upwardly into the pump room.

5. The personal watercraft according to claim 3, wherein the location where the exhaust passage passes through the bottom of the hull is on a bottom of the hull and adjacent a side of the pump room;

wherein the portion of the exhaust passage that passes through the bottom of the hull is connected to the inlet of the hollow portion; and wherein the exhaust outlet of the hollow portion opens laterally into the pump room.

6. The personal watercraft according to claim 2, wherein the engine is a four-cycle engine.

7. The personal watercraft according to claim, wherein the pump cover is made of aluminum and the hollow portion is integrally formed by casting with the pump cover.

8. The personal watercraft according to claim 2, wherein the exhaust passage includes a water muffler interposed between the engine and the hollow portion.

9. A personal watercraft, comprising:

an engine mounted within a hull, the engine having an exhaust port;

a water jet pump driven by the engine and configured to eject pressurized water to propel the watercraft, the water jet pump being housed in a pump room formed in a recess of the hull on an underside of the watercraft, the pump room being at least partially covered on a bottom side by a pump cover having a hollow portion formed therein; and a fluidically connected exhaust passage traveling from the exhaust port, to outside the hull, through the hollow portion of the pump cover, upward into the pump room, and through the pump room to the outside of the watercraft.

* * * * *